United States Patent [19]

Waltz

[11] 3,997,949

[45] Dec. 21, 1976

[54] CASKETS AND VAULTS FOR USE IN SIDE-BY-SIDE BURIALS

[76] Inventor: Maynard W. Waltz, 91 Smith St., South Portland, Maine 04106

[22] Filed: Jan. 22, 1975

[21] Appl. No.: 543,156

[52] U.S. Cl. ..... 27/2

[51] Int. Cl.[2] ..... A61G 17/00

[58] Field of Search ..... 27/2, 7, 8, 18

[56] References Cited

UNITED STATES PATENTS

| | | | |
|---|---|---|---|
| 1,779,488 | 10/1930 | Patterson | 27/2 |
| 1,887,665 | 11/1932 | Truman | 27/2 |
| 3,188,711 | 6/1965 | Koppen | 27/2 |
| 3,823,447 | 7/1974 | Johnson | 27/2 |

*Primary Examiner*—John D. Yasko

[57] ABSTRACT

Burial vaults are dimensioned to accommodate two caskets side-by-side and both the chambers and the covers therefor include lengthwise sections. The side walls of the caskets are provided with normally closed windows and their handles are of types enabling the two caskets to be positioned close together so that the width of each vault may be substantially less than the width of two conventional vaults.

10 Claims, 11 Drawing Figures

3
3
4
4
15
16
17
18
19
20
21
22
23
24
25
26
27
29
31
39

CASKETS AND VAULTS FOR USE IN SIDE-BY-SIDE BURIALS

BACKGROUND OF THE INVENTION

Burials entail many problems including those of adapting family wishes to the limitations imposed by available caskets, vaults, the cemetery lot and the requirements of a particular cemetery.

By way of example, it is not unusual for husband and wife to wish to be buried side-by-side with one burial, except in the case of a common disaster, preceding the other, sometimes by many years. As a consequence, the usual procedure is for a grave to be dug for the first one to die, a vault positioned therein and after the service, the casket lowered into the vault, the vault cover placed in position, the grave filled and the sods but back in place. On the death of the other, the same procedure is repeated so that each casket is in its own vault with the vaults spaced apart a distance that is in part dependent on the width of the lot and in part dependent on those digging the grave. As a consequence, the resulting side-by-side internment is less of a reality than the couple may have wished or envisioned.

THE PRESENT INVENTION

The general objective of the invention is to enable, when side-by-side burials are desired, the caskets to be closely spaced, an objective attained with special vaults and special caskets.

In accordance with the invention, this objective is attained, in the case of vaults, by providing that each vault is dimensioned to accommodate two caskets in a side-by-side relationship and includes an upwardly opening, casket-receiving chamber and a cover, the chamber having bottom, side and end walls and said bottom, end, and cover including two lengthwise sections provided with mating portions that are sealed together when the vault is completed in the grave, the construction making it possible to transport the sections as readily as a conventional, single casket vault and resulting in a vault whose width is less than that of two vaults of conventional dimensions, one for each casket, even if they can be installed with side walls in mutual contact.

In accordance with the invention, the general objective, in the case of caskets, is attained by providing that the handles of each casket, at least when the casket is at rest, do not protrude beyond the sides of the base of its chamber or its cover to an extent such that the two caskets cannot be placed in a common vault with their proximate sides substantially abutting, an objective attained, in one embodiment of the invention with handles having mounts attached to its sides. The hand grips of the handles extend along the transverse center of the mounts and with hand grip supports located and joined to the mounts at one side of the center line. As a result, with the handles along the proximate sides of two caskets arranged with the mounts of one such casket side inverted relative to those of the other casket, the hand grips are in the same plane but their supports are vertically spaced enabling the caskets to be positioned with the supports overlapping so that caskets may be placed closer together than would otherwise be possible thereby enabling the width of a double vault to be held to a minimum.

This general objective is attained in accordance with another embodiment of the invention, by providing that the handles are hingedly connected to the side walls of a casket so that they may be swung upwardly into a carrying position from a position of rest in which they lie within the boundary established by the sides of the chamber or the cover. Desirably, but not necessarily, when there are a plurality of separate handles on each side of the casket, their position of rest is wholly or partially within recesses.

Yet another objective of the invention is to provide the side walls of the casket with windows, an objective attained by forming each side wall of a casket with an opening adjacent its head end with a transparent member permanently closing each opening on the inside and an opaque member detachably attached to each side and closing the opening on the outside. This enables a casket to be conventional in appearance but with a window that can be "opened" to expose the interior of the casket if desired.

BRIEF DESCRIPTION OF THE DRAWINGS

In the accompanying drawings, illustrative embodiments of the invention are shown

THE PREFERRED EMBODIMENT OF THE INVENTION

Figures 1, 2, 3, 4:
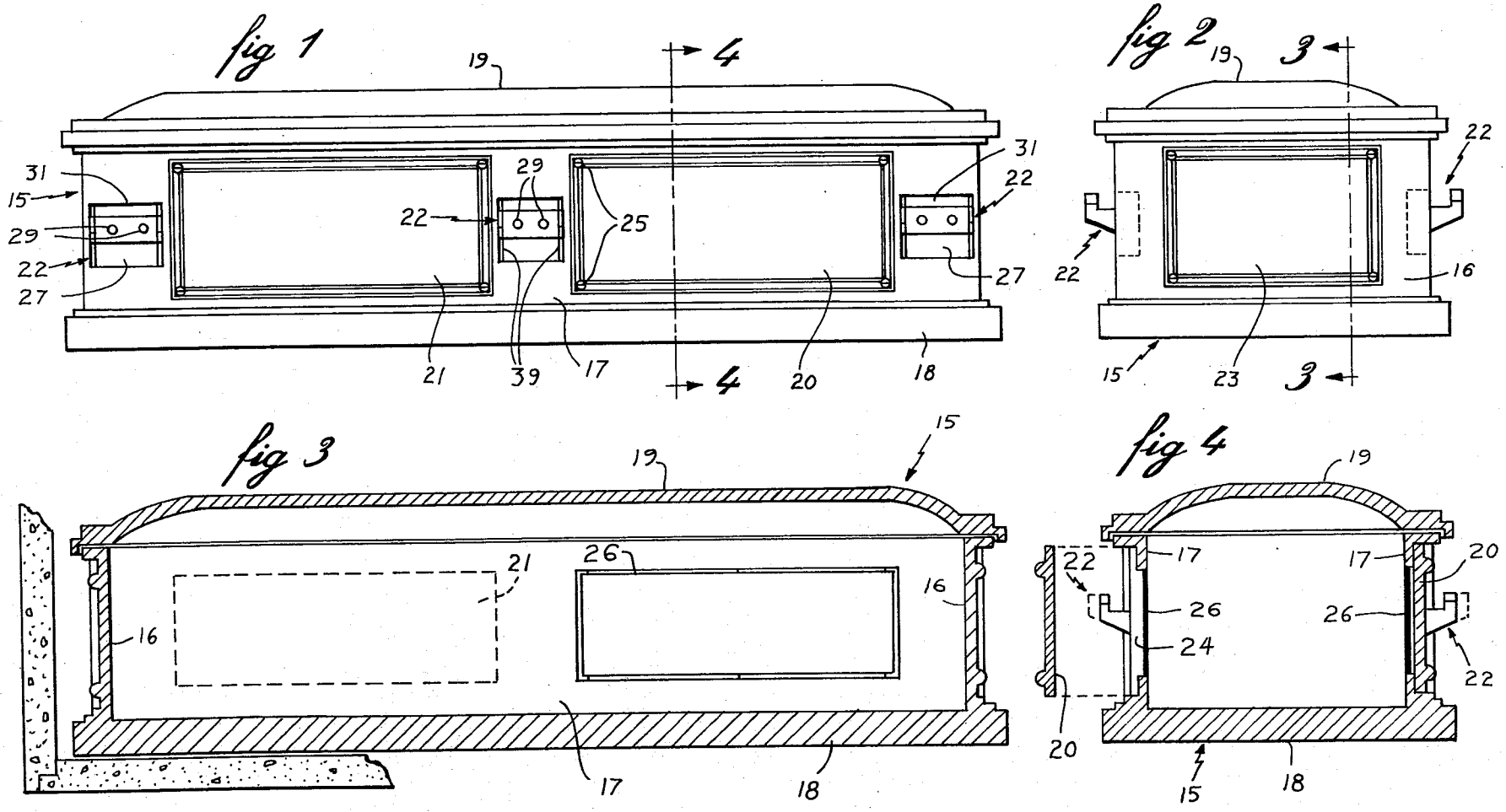
FIG. 1 is a side view of a casket in accordance with the invention.
FIG. 2 is an end view thereof.
FIG. 3 is a section taken approximately along the indicated line 3—3 of FIG. 2.
FIG. 4 is a section taken approximately along the indicated line 4—4 of FIG. 1.
Figure 6:
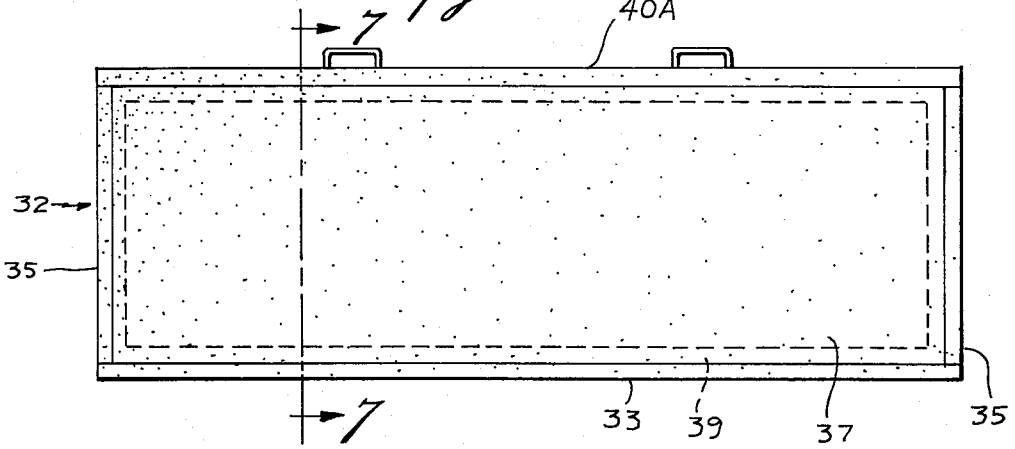
FIG. 6 is a side view thereof.
Figure 8:
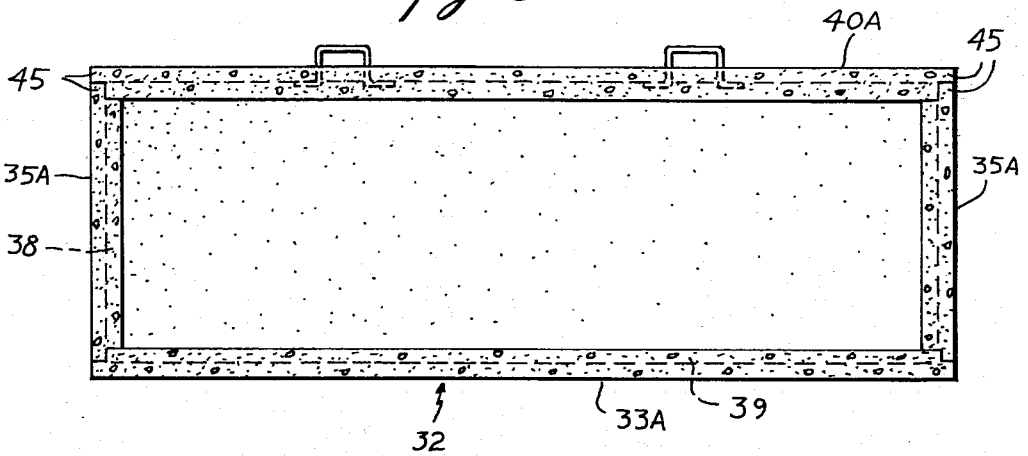
FIG. 8 is a section taken approximately along the indicated line 8—8 of FIG. 5.
Figure 5:
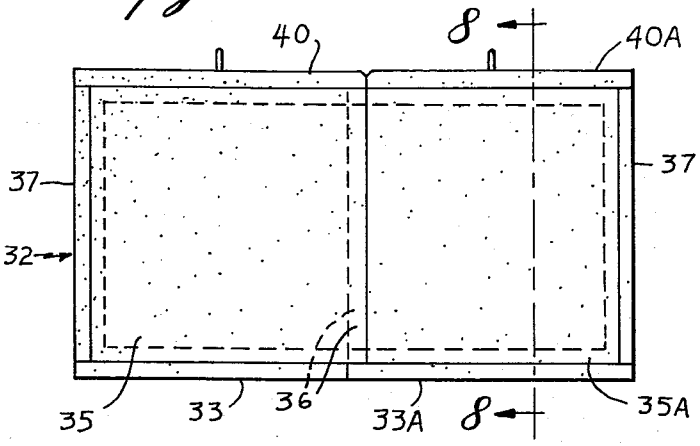
FIG. 5 is an end view of a vault in accordance with the invention.
Figure 7:
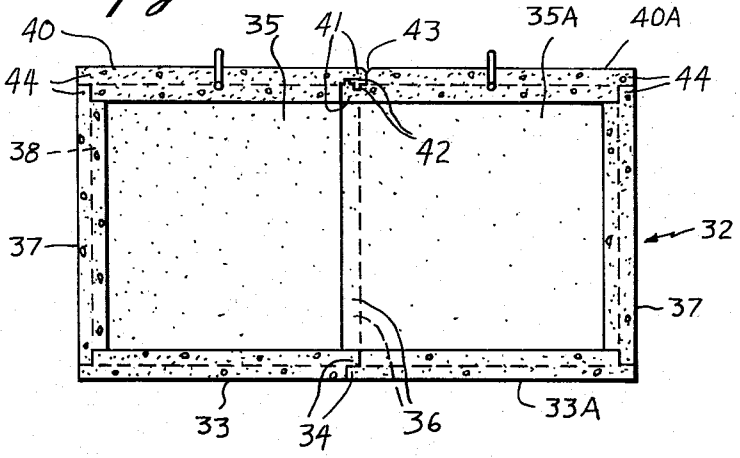
FIG. 7 is a section taken approximately along the indicated line 7—7 of FIG. 6.

The casket illustrated by FIGS. 1–4, 9 and 10 is shown somewhat schematically as caskets in accordance with the invention may be made of any materials and of any desired construction and accordingly, cover hinges, linings and the like are omitted to simplify the disclosure.

The casket, generally indicated at 15, is shown as having end walls 16, side walls 17, a bottom 18, and a cover or lid 19. The side walls 17 are shown as having panels 20 and 21 spaced lengthwise from each other and handles, generally indicated at 22 and shown as of an individual type with one adjacent each end of the casket and one between the panels 20 and 21. The end walls 16 are also shown as having panels 23.

Figure 9:
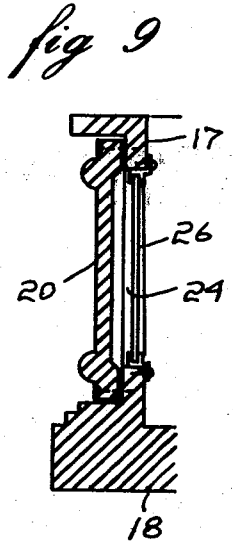
FIG. 9 is a fragmentary section, on an increase in scale, taken vertically through a closed casket window.

The panels 20, 21, and 23 are ornamental but the panels 20 have the function of closing, from the outside, an opening 24, one in each side wall 16 adjacent the head end of the casket 15, the panels 20 being detachably attached as by screws indicated at 25, see FIG. 9. The openings 24 are permanently closed on the inside by transparent windows 26 that are sealed in place. Thus while the casket 15 is or may be conventional in appearance and in function, it can be provided with a side window, if desired, as in the case of a sealed casket under some circumstances, for one example.

Figure 10:
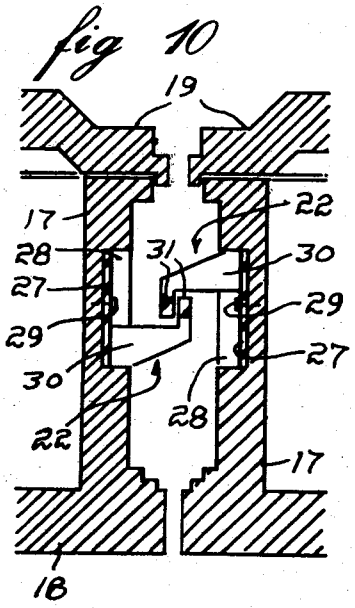
FIG. 10 is a like section taken vertically through the handles of two caskets with the mount of one handle in one position and the mount of the corresponding handle of the other casket side wall inverted so that the handle supports of one casket overlying those of the other casket.

It will be noted, see FIG. 10, that the handles 22 protrude laterally beyond the side margins of the casket bottom 18 and the covers 19 and in order to prevent their becoming so engaged that they would prevent the two caskets 15 from being placed in a common vault with said margins substantially in engagement, each handle 22 includes a mount 27 fitting within a socket 28 and secured therein as by screws 29. Each handle 22 includes end supports 30 and a hand grip 31 supported thereby and shown as in alignment with the transverse center line of its mount 27 with the supports 30 located wholly on one side thereof. As a consequence, when two caskets 15 are to be placed side-by-side, the handles 22 of one are inverted relative to the handles 22 of the other casket, so that the supports 30 may overlap but both sets of hand grips 21 are in the same horizontal plane so that the handles 22 do not prevent the marginal portions of the two caskets 15 from being positioned substantially in abutment.

When it is desired that a vault be used, as is usually the case, the vault, see FIGS. 5 – 8 is dimensioned to receive two caskets 15 when placed side-by-side therein. As a vault of unitary construction would be cumbersome to carry and unload, it is preferred that its casket receiving portion or chamber, generally indicated at 32, have its bottom consist of half sections 33 and 33A, see FIG. 7, with their abutting margins provided with complemental shoulders 34 and the end walls also consist of half sections 35 and 35A with their abutting margins provided with complemental shoulders 36.

If desired, and as shown, the vault side walls 37 may be formed separately from the appropriate end wall and bottom sections in which case the abutting margins of each side and of the appropriate end wall sections have complemental shoulders 38 and the abutting margins of each side wall and the appropriate bottom section have complemental shoulders 39.

It is essential that the vault cover consist of sections 40 and 40A with their abutting margins formed with complemental shoulders 41. Each shoulder 41 is channelled to receive a sealing strip 42 and the abutting edges of the cover sections are also shouldered to provide a relatively narrow and shallow channel 43 to receive grouting, not shown in the drawings, providing an effective seal that may be readily broken when the cover section 40 is pulled upwardly. The margins of the cover sections that are to be supported by the side and end walls of the vault chamber 32 and said side and end walls have complemental shoulders 44 and 45, respectively. It will be noted that the cover section 40 is slightly wider than the section 40A for reasons presently to be explained.

In use, where, for example, a husband and wife desired to be buried side-by-side, a grave is dug when the first one of them dies that is dimensioned to receive a vault in accordance with the invention. After the service, the casket 15 with its handles 22 positioned with the hand grip supports 30 below the plane of the hand grips 31 is lowered into the vault chamber 32 substantially against the side wall 37 in a position to be below the cover section 40A. The cover sections 40 and 40A are then put in place and the vault covered and the ends replaced.

When the other person dies, the grave is prepared simply by exposing enough of the vault cover to permit the cover section 40 to be removed. It will be noted that at least the handles 22 at one side of the casket that is already in the vault are exposed when the cover section 40 is removed. After the service, the casket 15 is lowered into the vault chamber 32 with its handles 22 so positioned that the hand grip supports 30 are above the plane of the hand grips 31 with the supports 30 partially overlapping and the handles caught together. The cover section 40 is then replaced and the channel 43 again filled with grouting or other suitable sealing compound. A casket 15 may be placed in the vault chamber 32 with proximate panels 20 removed, see FIG. 9.

Figure 11:
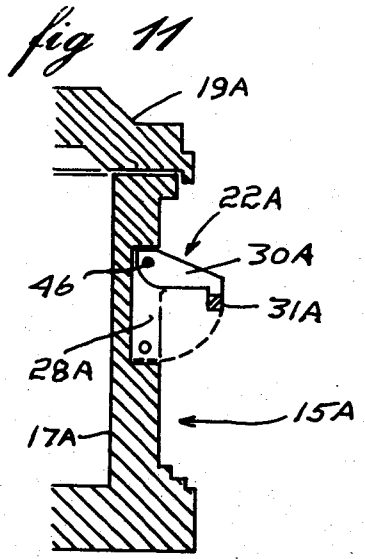
FIG. 11 is a similar, fragmentary section showing a hinged handle embodiment of the invention.

If preferred, the handles may be hingedly connected to the sides of a casket, see FIG. 11, and as the casket structure may be the same as that previously described, corresponding parts will not again be detailed but are distinguished by the suffix addition A to the appropriate reference numerals.

The handles 22A have supports 30A for the hand grips 31A connected to mounts 27A by pivots 46 and it is preferred and as shown, that each handle 22B be within a socket 28A when at rest.

It will thus be apparent that not only may the caskets 15 be used in the previously described manner but also they may be used conventionally. In addition, it will be appreciated that costs attendant the second burial are decreased since the vault is already in place and the amount of excavation necessary is substantially reduced.

I claim:

1. A casket comprising a body-receiving chamber and a cover therefor, handles secured to the sides of said chamber and including hand grips, said handles including bases, and supporting means connecting said hand grips to said bases with the hand grips located along the transverse center lines thereof at least when the casket is being carried, and with the supporting means wholly on one side thereof, and means attaching said bases to said sides with said hand grips parallel whether the bases are positioned with the supporting means above or below the center lines.

2. The casket of claim 1 in which each side of the body-receiving chamber has a socket dimensioned to receive a base.

3. The casket of claim 2 in which there is a plurality of separate handles spaced lengthwise of each side of the body receiving portion and at least one of the sides of the casket-receiving chamber has an opening adjacent the front end thereof between two handles, a transparent member permanently closes the opening on the inside thereof and an opaque member detachably attached to said side closes the opening from the outside.

4. The casket of claim 1 in which the handles include a hinge connection with the side walls of the chamber.

5. The casket of claim 1 in which the supporting means of the handle are pivotally connected to the base.

6. The casket of claim 1 in which at least one side of the body-receiving portion has an opening adjacent the front end thereof, a transparent member permanently closes the opening on the inside thereof and an opaque member detachably attached to said side closes the opening from the outside.

7. A casket comprising a body-receiving portion and a cover therefor, said portion including an opening in at least one of its sides adjacent the front end thereof, a transparent member permanently closing said opening from the inside and an opaque member detachably attached to said side and closing said opening from the outside.

8. In combination, a burial vault dimensioned to receive two caskets side-by-side and including bottom, side and end portions and a cover portion, at least said bottom, end and cover portions including two lengthwise sections of the same width, the sections of each portion including complementary shaped margins sealed together, said caskets each including a body-receiving chamber and a cover therefor and handles secured to the sides of said body-receiving portions and projecting beyond the side boundaries of the caskets, the handles of the adjacent sides including hand grips in the same plane and supporting means therefor connected to the sides of the body-receiving chambers and vertically spaced with the supporting portions overlapping thereby to reduce the overall width of the space occupied by the two caskets.

9. A burial vault dimensioned to receive two caskets side-by-side and including bottom, side and end portions and a cover portion, at least said bottom, end and cover portions including two lengthwise sections, at least those of the bottom portion of the same width, the sections of each portion including complementary shaped margins sealed together, and the abutting margins of the sections of the cover portion including boundaries defining a channel for a seal, the channel being relatively shallow to enable the seal to be readily broken when one section of the cover portion is to be opened for the introduction of a casket into the subjacent space.

10. The burial vault of claim 9 in which the cover sections are of unequal widths.

* * * * *